US010895155B2

(12) United States Patent
Yamazaki et al.

(10) Patent No.: US 10,895,155 B2
(45) Date of Patent: Jan. 19, 2021

(54) PACKAGE TYPE COMPRESSOR

(71) Applicant: Hitachi Industrial Equipment Systems Co., Ltd., Chiyoda-ku, Tokyo (JP)

(72) Inventors: Shumpei Yamazaki, Tokyo (JP); Takuya Kunitomo, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 291 days.

(21) Appl. No.: 14/869,176

(22) Filed: Sep. 29, 2015

(65) Prior Publication Data

US 2016/0097389 A1 Apr. 7, 2016

(30) Foreign Application Priority Data

Oct. 2, 2014 (JP) ..... 2014-204072

(51) Int. Cl.
*F04C 18/02* (2006.01)
*F04C 23/02* (2006.01)
(Continued)

(52) U.S. Cl.
CPC ..... *F01C 21/007* (2013.01); *F04B 39/066* (2013.01); *F04B 53/08* (2013.01);
(Continued)

(58) Field of Classification Search
CPC ..... F04B 49/03; F04B 39/006; F04B 53/08; F04B 39/066; F04C 18/0215; F04C 29/04; F04C 2240/403; F01N 1/10; B01D 53/26
(Continued)

(56) References Cited

U.S. PATENT DOCUMENTS 4,929,161 A * 5/1990 Aoki ..... F04C 29/04 418/101
5,417,554 A * 5/1995 Kietzman ..... F04C 29/04 418/101
(Continued)

FOREIGN PATENT DOCUMENTS

CN 1229887 A 9/1999
CN 1332322 A 1/2002
(Continued)

OTHER PUBLICATIONS

English Translation of JP 2008-175156 obtained Sep. 25, 2017.*
(Continued)

*Primary Examiner* — Connor J Tremarche
(74) *Attorney, Agent, or Firm* — Crowell & Moring LLP

(57) ABSTRACT

A package type compressor includes a housing, a compressor, a motor, an inverter, and a cooling fan. The housing has an air inlet. The compressor is disposed inside the housing where it compresses the air. The compressor is disposed in a compressor body inside the housing. The motor is disposed above the compressor inside the housing, and drives the compressor. The inverter is disposed in the region of the air inlet of the housing, and controls a rotation speed of the motor. The cooling fan is disposed inside of the compressor body. The cooling fan generates a flow path of cooling air within the package type compressor. The inverter is disposed in such a way that as the flow path of cooling air enters the air inlet of the housing, the flow path of cooling air passes directly over the inverter thereby cooling the inverter.

9 Claims, 6 Drawing Sheets

(51) Int. Cl.
*F01C 21/00* (2006.01)
*F04C 29/04* (2006.01)
*F04B 39/06* (2006.01)
*F04B 53/08* (2006.01)

(52) U.S. Cl.
CPC ..... *F04C 29/04* (2013.01); *F04C 18/0215* (2013.01); *F04C 2240/403* (2013.01)

(58) Field of Classification Search
USPC ..... 417/295, 423.8
See application file for complete search history.

(56) References Cited

U.S. PATENT DOCUMENTS 5,647,731 A * 7/1997 Onozawa ..... F04B 49/03 417/295
6,000,623 A * 12/1999 Blatti ..... G06F 1/20 165/80.3
6,193,486 B1 * 2/2001 Shiinoki ..... B01D 53/26 418/101
6,538,881 B1 * 3/2003 Jeakins ..... H05K 7/20572 165/122
6,551,082 B2 * 4/2003 Douzono ..... F04C 29/04 418/201.1
6,572,350 B2 * 6/2003 Takahashi ..... F04C 23/00 137/100
6,599,104 B2 * 7/2003 Saito ..... F04C 23/008 417/366
6,679,689 B2 1/2004 Takahashi et al.
7,708,538 B2 * 5/2010 Kawabata ..... F04C 29/04 417/243
7,845,463 B2 * 12/2010 Yabe ..... F01N 1/10 181/198
2006/0093489 A1 * 5/2006 Hernandez ..... F04B 35/06 417/234
2006/0245937 A1 * 11/2006 Goodwin ..... F04B 35/06 417/234

FOREIGN PATENT DOCUMENTS

JP 2008-175156 A 7/2008
JP 2008175156 A * 7/2008

OTHER PUBLICATIONS

Chinese-language Office Action issued in counterpart Chinese Application No. 201510629494.4 dated Aug. 8, 2018 with English translation (19 pages).

* cited by examiner

PACKAGE TYPE COMPRESSOR

TECHNICAL FIELD

The present invention relates to a compressor which compresses the fluid such as air and refrigerant, and particularly relates to the cooling of a package type compressor which houses a compressor body, a motor driving the compressor body and an inverter controlling the rotation of the motor in the package.

BACKGROUND ART

As a background art of the present technique, there is JP-A-2008-175156 (Patent Literature 1). In Patent Literature 1, there is disclosed a compressor including a compression part, a motor driving the compression part, an inverter device driving the motor, a cooling fan exhausting air used for cooling the interior of the compressor inside a package, in which an air suction port is provided in the package, and air taken in from the air suction port cools the inverter device, then, cools the motor.

CITATION LIST

Patent Literature

[PTL 1] JP-A-2008-175156

SUMMARY OF INVENTION

Technical Problem

As the compressor disclosed in Patent Literature 1 is provided with the cooling fan for cooling the interior of the package, a motor dedicated to the cooling fan is necessary, therefore, there are problems that costs are increased and that the arrangement of respective parts is restricted, and the productivity is decreased.

The invention has been made in view of the above problems in related art, and an object thereof is to provide a package type compressor capable of improving the productivity by reducing the restriction in arrangement of respective parts while securing the cooling of the inverter.

Solution of Problem

The invention applies structures, for example, descried in claims for solving the above problems. The invention includes plural means for solving the above problems. As one of the means, there is provided a package type compressor including a compressor body compressing the air, a motor driving the compressor body, an inverter controlling rotation speed of the motor, and a cooling fan provided in the compressor body, in which the inverter is provided in an intake path of cooling air generated by the cooling fan provided in the compressor body.

Advantageous Effects of Invention

According to the invention, it is possible to provide a package type compressor capable of improving the productivity by reducing the restriction in arrangement of respective parts while securing the cooling of the inverter.

DESCRIPTION OF EMBODIMENTS

Hereinafter, examples of the invention will be explained with reference to the drawings.

Example 1

Figure 1:
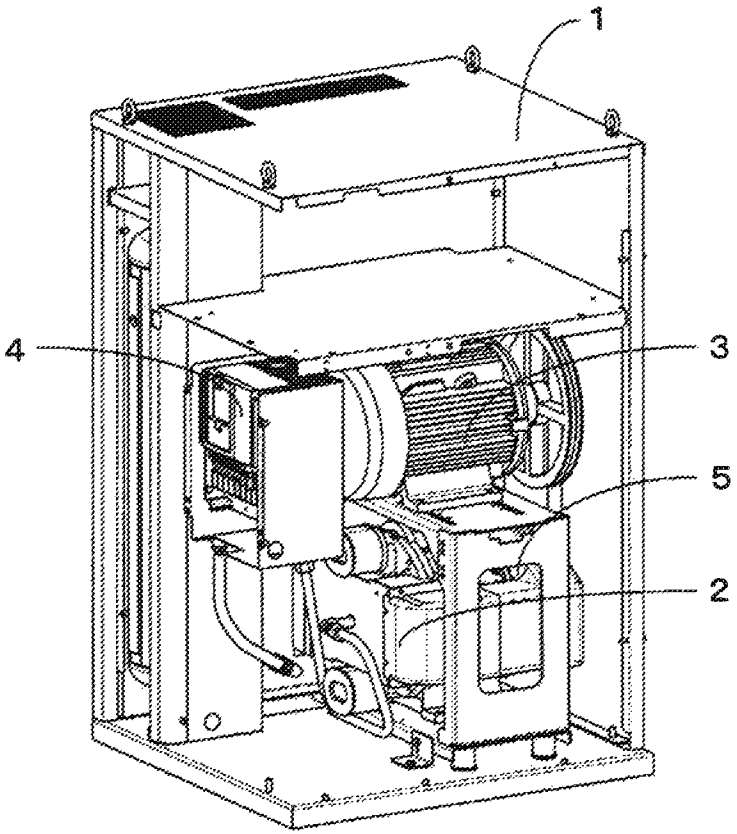
FIG. 1 is a schematic view showing a state where part of outer panels is removed in a package type compressor according to Example 1.

FIG. 1 is a schematic view showing a state where part of outer panels is removed in a package type compressor according to the example. In FIG. 1, a scroll compressor body 2 compressing the air, a motor 3 driving the scroll compressor body 2, an inverter 4 controlling rotation speed of the motor 3 and a cooling fan 5 cooling the scroll compressor body 2 are installed inside a casing 1. The inverter 4 is installed in an intake path of cooling air in the scroll compressor body 2. The cooling fan 5 is built in the scroll compressor body 2, which rotates in synchronization with the rotation of the compressor body to perform cooling.

Though the example in which the scroll compressor is used as the compressor body is explained, the compressor body is not limited to this. Compressor bodies other than the scroll compressor body requiring cooling by the cooling air may be used, for example, a reciprocating compressor, a screw compressor and so on may be used.

Figure 2:
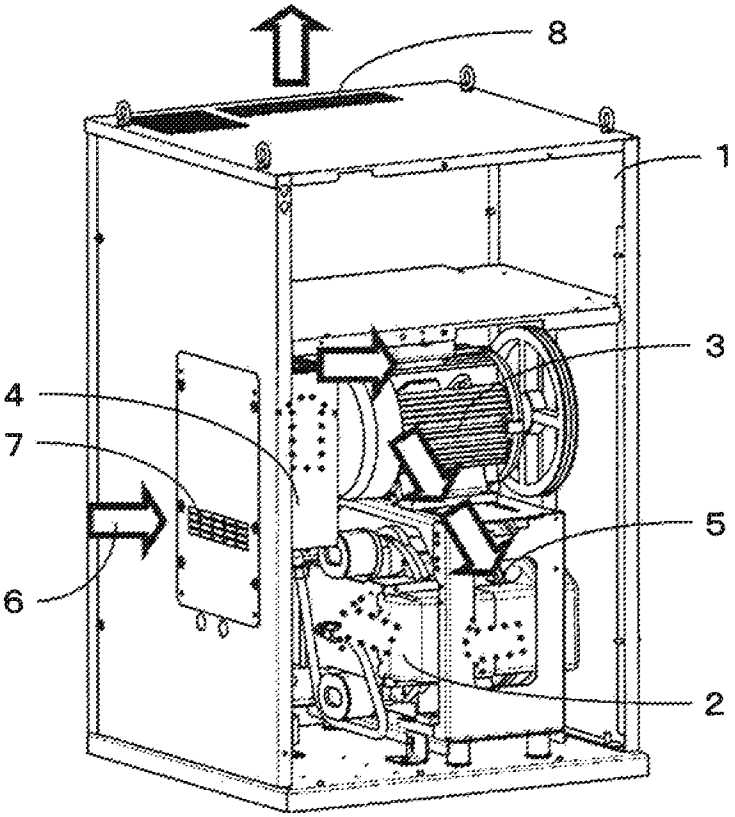
FIG. 2 is a schematic view showing the flow of cooling air of the package type compressor according to Example 1.

The flow of cooling air according to the example will be explained with reference to FIG. 2. FIG. 2 is a schematic view showing the flow of cooling air of the package type compressor according to the example, showing a state where a side surface part in FIG. 1 is covered by a panel. In FIG. 2, a cooling air 6 shown by arrows is first sucked by the cooling fan 5 through an intake port 7 provided on the panel from the outside of the casing 1 and passes a circulation path including a duct surrounding the inverter 4 as shown in FIG. 1, thereby cooling the inverter 4. It is also preferable that the inverter is provided with a radiating fin to be cooled in the path of cooling air. After that, the motor 3 and the scroll compressor body 2 are cooled by the cooling air. The cooling air used for cooling the scroll compressor body 2 is exhausted from an exhaust port 8 through a back side in FIG. 2 as shown by dotted-line arrows.

Figure 3:
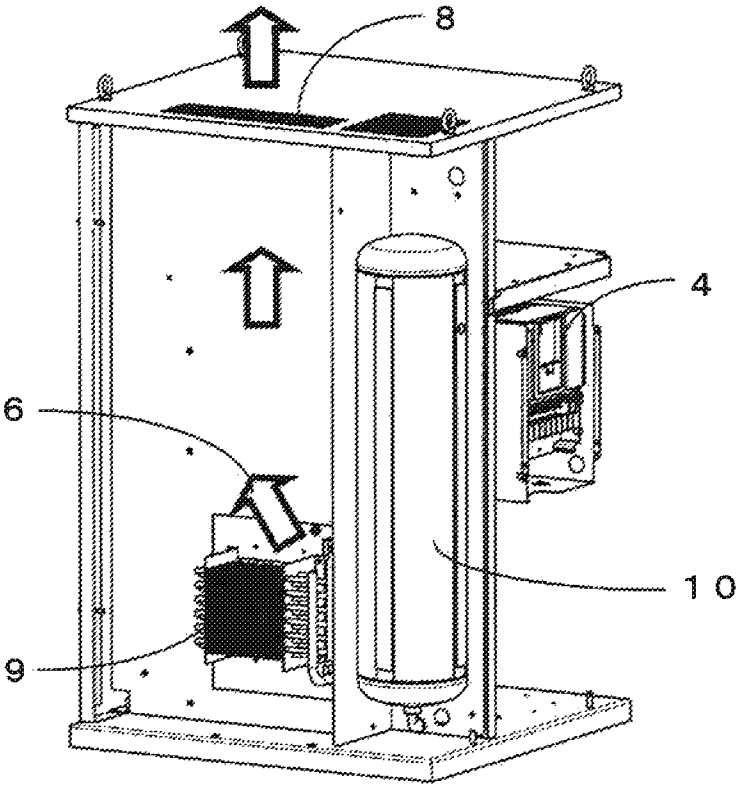
FIG. 3 is a schematic view showing the flow of cooling air in a back side of the package type compressor according to Example 1.

The flow of cooling air in the back side of the package type compressor according to the example will be explained with reference to FIG. 3. FIG. 3 is a view of the package type compressor of FIG. 2 seen from the back, which is a schematic view in a state where part of the otter panels is removed. In FIG. 3, an after cooler 9 which cools the air compressed by the scroll compressor body and an air tank 10 storing the compressed air cooled by the after cooler 9 are arranged in the back of the package type compressor. The cooling air 6 cools the after cooler 9 after cooling the scroll compressor body 2, then, exhausted from the exhaust port 8.

Figure 4:
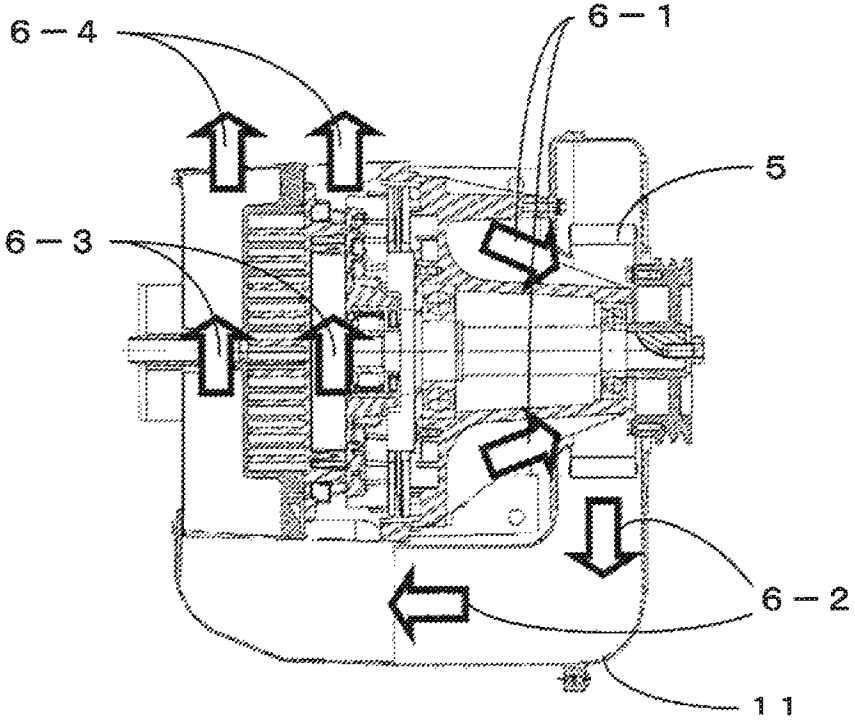
FIG. 4 is a schematic view showing the flow of cooling air in a compressor body according to Example 1.

FIG. 4 is a schematic view showing the flow of cooling air in the scroll compressor body 2 according to the example, which is a cross sectional view of the scroll compressor body 2 seen from above. Concerning the cooling air 6, the cooling air is sucked as shown by an arrow 6-1 by the cooling fan 5 of the scroll compressor body 2, and the scroll compressor body 2 is cooled by cooling air shown by an arrow 6-3 via a duct 11 as shown by an arrow 6-2, then, the cooling air is exhausted as shown by an arrow 6-4 to be circulated to the after cooler 9 side in the back side of the package type compressor.

As described above, the inverter 4 is installed in the intake path of cooling air by the cooling fan 5 provided in the scroll compressor body 2 and is cooled by the cooling air 6 generated by the cooling fan 5 which cools the scroll compressor body 2, therefore, it is not necessary to provide a cooling fan dedicated to the inerter 4. Accordingly, the costs can be reduced and the productivity can be improved by reducing the restriction in arrangement of respective parts while securing the cooling of the inverter. Also in the example, the motor 3 can be cooled by providing the motor 3 in the path of cooling air.

In the case where the cooling fan dedicated to the inverter 4 or, a dedicated cooling far for cooling the entire package type compressor is provided separately from the cooling fan provided in the compressor body for cooling the compressor body, it is difficult to use the package type compressor when the dedicated cooling fan is broken. Whereas, in the example, the cooling fan is normal when the compressor body is normal, therefore, the package type compressor can be used, which leads to an advantage that the reliability is increased. Additionally, as the cooling fan which cools the compressor body operates in synchronization with the motor which drives the compressor body, the rotation of the compressor body is decreased. When the rotation of the compressor body is reduced and the compressing operation of the compressor is decreased, the temperature increase is reduced and necessity of cooling is also reduced, therefore, there is another advantage that an energy-saving effect can be expected as it is not necessary to operate the cooling fan when not required.

Example 2

The example is one in which a pipe connecting an air tank for storing compressed air to an air dryer for dehumidifying the compressed air is provided in the path of cooling air.

Figure 5:
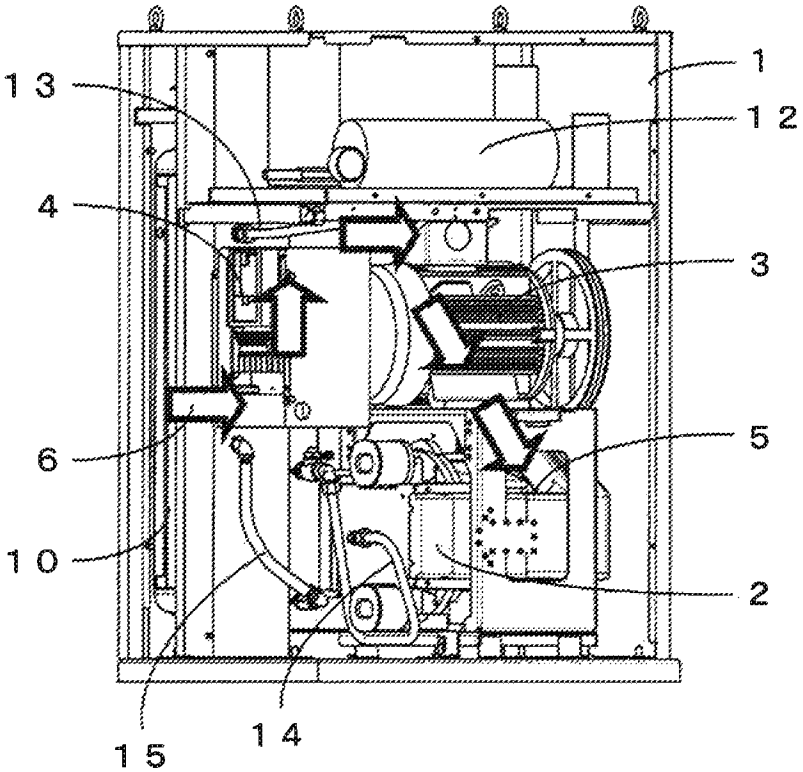
FIG. 5 is a schematic view showing a state where part of outer panels is removed in a package type compressor according to Example 2.

FIG. 5 is a schematic view showing a state where part of outer panels is removed in a package type compressor according to the example. The same numerals are given to the same components as those of Example 1, and explanation thereof is omitted.

In FIG. 5, a pipe 13 connecting an air tank 10 for storing compressed air compressed by the scroll compressor body to an air dryer 12 for dehumidifying the compressed air is a flow path of the compressed air, therefore, the pipe 13 is provided in the path of the cooling air 6. Accordingly, the compressed air flowing into the air dryer 12 can be cooled without providing a dedicated cooling fan for cooling the compressed air, thereby reducing the costs and improving the productivity by reducing the restriction in arrangement of respective parts while improving the reliability of the air dryer 12.

Though the pipe 13 connecting the air tank 10 to the air dryer 12 is provided in the path. of the cooling air 6 in the example, for example, the path of the compressed air which connects the compressor body to the air tank may be cooled. As the compressed air discharged from the compressor body follows the path to the air tank via the after cooler in the example, for example, the a pipe 14 which is a path of compressed air which connects the compressor body to the after cooler may be cooled and a pipe 15 which is a path of compressed air which connects the after cooler to the air tank may be cooled.

The air tank 10 and the air dryer 12 can be installed outside the casing 1. In this case, the path of compressed air cooled by the cooling air 6 is the above path of compressed air which connects the scroll compressor body 2 to the outlet of the compressed air in the casing 1.

Example 3

The example is one in which a second intake port allowing the cooling air to flow into the cooling fan without passing the cooling path to the inverter.

Figure 6:
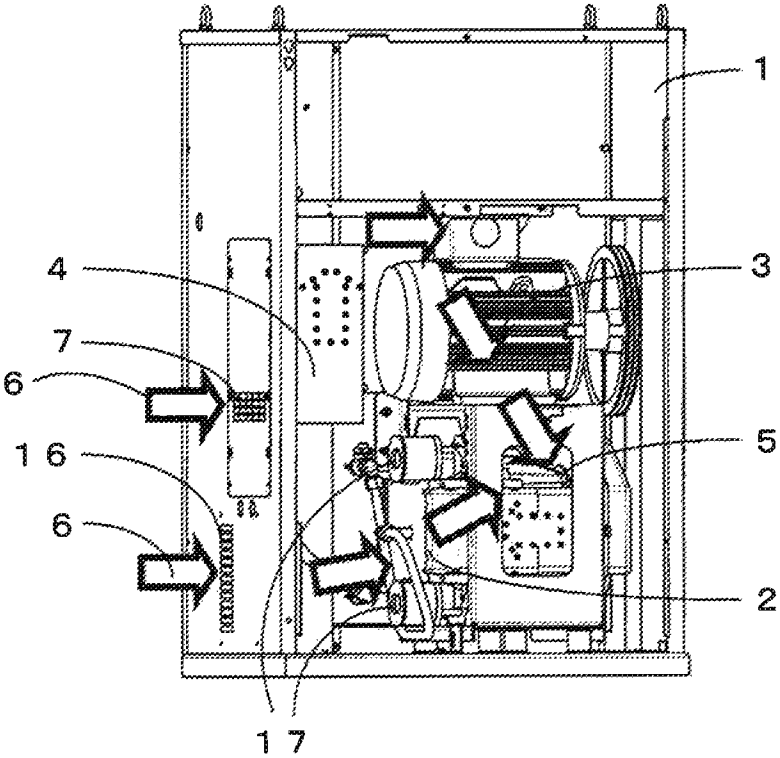
FIG. 6 is a schematic view showing a state where part of outer panels is removed in a package type compressor according to Example 3.

FIG. 6 is a schematic view showing a state where part of outer panels is removed in a package type compressor according to the example. The same numerals are given to the same components as those of Example 1, and explanation thereof is omitted.

In FIG. 6, an intake port 16 allowing the cooling air to flow into the cooling fan 5 without passing the cooling path to the inverter 4 is provided on the panel separately from the intake port 7 for cooling the inverter 4. Accordingly, part of the cooling air for cooling the scroll compressor body 2 can be directly taken in from the outside of the casing, therefore, the cooling efficiency of the scroll compressor body 2 can be increased and the reliability can be improved as compared with Example 1 in which all the cooling air passes the invert. Moreover, as the air taken in from air suction ports 17 of the scroll compressor body 2, not air the temperature of which is increased inside the package type compressor but outside air taken in from the intake port 16 can be directly taken in, which is effective to reduce the temperature of the scroll compressor body 2.

Though the example has been explained based on Example 1, the present example may be applied in Example 2.

The examples have been explained as the above, and the present invention is not limited to the above examples and various modification examples are included. For example, the above examples have been explained in detail for explaining the present invention so as to be easy to understand, and the present invention is not always limited to examples which include all the components explained above. It is also possible to replace part of components in one example with components of another example as well as to add components of another example to components of one example. Furthermore, addition, omission and replacement can be performed with respect to part of components of respective examples.

REFERENCE SIGNS LIST

1: casing, 2: scroll compressor body, 3: motor, 4: inverter, 5: cooling fan, 6, 6-1, 6-2, 6-3 and 6-4: cooling air, 7, 16: intake port, 8: exhaust port, 9: after cooler, 10: air tank, 11: duct, 12: air dryer, 13, 14, 15: pipe, 17: air suction port of compressor body

The invention claimed is:

1. A package type compressor comprising:

a compressor body including a cooling fan;

an after cooler cooling compressed air compressed by the compressor body;

a motor driving the compressor body;

an inverter controlling a rotation speed of the motor;

an air tank being disposed between and immediately adjacent to the inverter and the after cooler; and a housing that stores the compressor body, the after cooler, the motor, and the inverter, wherein the inverter and the motor are arranged between an intake port provided in the housing and the discharge port of the cooling fan, an air supply port of a flow path for cooling the compressor body is provided at the discharge port of the cooling fan, the after cooler is disposed between a discharge port of the flow path and a discharge port provided in the housing, and the air tank is enclosed within a first separate compartment that is different from a second compartment in which the compressor body is enclosed, the first separate compartment being formed in a corner of the housing.

2. The package type compressor according to claim 1, wherein a rotating shaft of the cooling fan rotates integrally with a rotating shaft of the compressor body.

3. The package type compressor according to claim 1, wherein a path of the compressed air compressed by the compressor body is provided between the discharge port of the flow path and the discharge port provided in the housing.

4. The package type compressor according to claim 1, wherein a path of the compressed air is a pipe connecting the compressor body to the after cooler.

5. The package type compressor according to claim 1, wherein a path of the compressed air is a pipe connecting the after cooler connected to the compressor body to the air tank.

6. The package type compressor according to claim 3, wherein the path of the compressed air is a pipe connecting the air tank storing the compressed air to an air dryer.

7. The package type compressor according to claim 1, wherein a plurality of intake ports are provided in the housing.

8. The package type compressor according to claim 7, wherein the inverter and the motor are arranged between at least one intake port of the plurality of intake ports and the cooling fan.

9. The package type compressor according to claim 1, wherein the compressor body is a scroll compressor.

* * * * *